US008378648B2

(12) United States Patent
Unetich et al.

(10) Patent No.: US 8,378,648 B2
(45) Date of Patent: Feb. 19, 2013

(54) LINEAR REGULATOR WITH AUTOMATIC EXTERNAL PASS DEVICE DETECTION

(75) Inventors: Richard T Unetich, Chicago, IL (US); Carl E Wojewoda, Lake Zurich, IL (US)

(73) Assignee: Freescale Semiconductor, Inc., Austin, TX (US)

( * ) Notice: Subject to any disclaimer, the term of this patent is extended or adjusted under 35 U.S.C. 154(b) by 578 days.

(21) Appl. No.: 12/606,826

(22) Filed: Oct. 27, 2009

(65) Prior Publication Data

US 2011/0095744 A1 Apr. 28, 2011

(51) Int. Cl.
*G05F 1/56* (2006.01)

(52) U.S. Cl. ..... 323/269; 323/274; 307/87

(58) Field of Classification Search ..... 323/269, 323/274, 279; 307/86, 85, 80
See application file for complete search history.

(56) References Cited

U.S. PATENT DOCUMENTS

| | | | | |
|---|---|---|---|---|
| 5,828,205 | A | 10/1998 | Byrne | |
| 6,469,480 | B2 | 10/2002 | Kanakubo | |
| 6,570,367 | B2 * | 5/2003 | Bartenschlager et al. | 323/269 |
| 7,088,015 | B2 * | 8/2006 | Vulih et al. | 307/86 |
| 7,106,032 | B2 | 9/2006 | Chen et al. | |
| 7,218,168 | B1 | 5/2007 | Rahman | |
| 7,345,378 | B2 | 3/2008 | Pearce | |
| 7,382,064 | B2 * | 6/2008 | Jaisinghani et al. | 307/87 |
| 7,388,793 | B2 | 6/2008 | Cascone et al. | |
| 7,437,252 | B2 | 10/2008 | Sutardja | |
| 7,446,432 | B2 | 11/2008 | Cha | |
| 7,859,134 | B2 * | 12/2010 | Chi et al. | 307/80 |
| 8,120,390 | B1 * | 2/2012 | Mack | 327/108 |
| 2005/0206355 | A1 * | 9/2005 | Leith et al. | 323/274 |
| 2008/0048631 | A1 | 2/2008 | Kim | |
| 2008/0191670 | A1 * | 8/2008 | Oddoart et al. | 323/273 |

OTHER PUBLICATIONS

MC13783 Power Management and Audio Circuit Technical Data Sheet, Document No. MC13783/D REV. 3,4, pp. 1-50, Freescale Semiconductor, Inc., Mar. 22, 2007.

MC13783 Power Management and Audio Component Fact Sheet, Document No. MC13783PMFS REV. 1, pp. 1-2, Freescale Semiconductor, Inc., Jun. 21, 2007.

MCIMX31 Multimedia Applications Processor Technical Data Sheet, Document Number: MCIMX31 REV. 4.1, pp. 1-122, Freescale Semiconductor, Inc., Nov. 2008.

* cited by examiner

*Primary Examiner* — Harry Behm
(74) *Attorney, Agent, or Firm* — Patents and Licensing LLC; Daniel W Juffernbruch

(57) ABSTRACT

A power regulator circuit automatically disables an internal pass transistor when a detection circuit detects the presence of an external pass device. The internal pass transistor is made in an integrated circuit along with a detection circuit and a switch for disabling the internal pass transistor. The detection circuit detects a presence of an external pass device external to the integrated circuit. The switch automatically disables the internal pass transistor when the detection circuit detects the presence of the external pass device. The detection circuit has a comparator for comparing a signal on an outside connection of the integrated circuit and a latch to operate the switch. The comparator compares a voltage on an outside connection of the integrated circuit against a reference after power up of the regulator and can delay operation of the comparison until a predetermined time after power up. An integrated circuit can contain the power regulator circuit and the internal pass transistor. The power regulator circuit can be used on a power supply with a DC power source.

18 Claims, 6 Drawing Sheets

LINEAR REGULATOR WITH AUTOMATIC EXTERNAL PASS DEVICE DETECTION

BACKGROUND OF THE INVENTIONS

1. Technical Field

The present inventions relate to power regulator circuits and, more particularly, relate to regulators that use pass devices.

2. Description of the Related Art

In many implementations, it is often advantageous to have a power regulator that can use either an external pass device or an internal pass device as part of the general regulator topology. The pass device is that device in a series (as distinct from shunt) regulator that passes current from the power source to the load. Use of an external pass device is generally done to place most of the power dissipation on the external pass device, rather than entirely with the remainder of the regulator, which may be on an integrated circuit (IC). The integrated circuit may or may not have other significant power dissipation sources, so thermal management may be a system concern. An internal pass device is usually selected when power dissipation is not a concern, and the area and cost of the external pass device may be avoided. The topology of a series regulator using a series pass transistor for a pass device whose low impedance terminals couple a source of power to a load and whose high impedance terminal couples to an error amplifier that increases difference between an output, which may or may not be scaled, and a reference signal is known.

It has been common for prior integrated circuits to connect via a bus to a system controller to direct a portion of the startup sequence for the power regulators. This was commonly used for startup of an integrated circuit such as MC13783, manufactured and sold by Freescale, Inc. The MC13783 integrated circuit contained dozens of functional circuits such as an audio amplifier and microphone system, audio analog-digital codecs, general analog to digital converter, battery charger, color led display drivers and backlights, touch screen interface, time of day clock and several power regulators to power these within. The MC13783 integrated circuit had several pin-programmable minimum startup sequences and other startup sequences directed by a system controller. The MC13783 integrated circuit startup sequences directed by the system controller included validation of battery voltage, verification of why power was requested, detecting which accessories were attached and configuration and startup of the power regulators. The system controller and software sometimes enabled some power regulators before others. The software specified a default state for regulators which may use either an internal pass device or an external pass device. A startup sequence was advantageous for power regulators because it minimized current consumption, since not all the regulators needed to be on by default. However, in this example of the art, care had to be used in defining the startup sequence to assure that the software for the system controller was correct and every circuit necessary for startup had an activated regulator.

FIG. 1 illustrates a schematic block diagram from the prior art where a power regulator capable of supporting internal or external pass devices was configured to use an external pass device 185 to power a load 189 from a battery or power supply 181. When in this mode, the interstage amplifier 115 was also enabled. To be used in this mode, a bus 190 provided a configure command from the bus 190. The configure command from the bus 190 needed to be set so that the external pass device 185 was actively driven, and the internal pass device 180 was not. FIG. 1 also illustrates differential amplifier 110, level select 120, output pulldown 130, not enable 135, inverter 193, and external bypass capacitor 187.

FIG. 2 illustrates a schematic block diagram of the same power regulator from the prior art to power a load 289 from a battery or power supply 281, but unlike in FIG. 1, an internal pass device was used. Note the configure command from the bus disabled the interstage amplifier, to save current, and routed the output of the error amplifier to the gate of the internal pass device. A bus 290 provided a configure command which needed to be set to actively drive the internal pass device 280 rather than an external pass device, and an interstage amplifier 215 was disabled. FIG. 2 also illustrates differential amplifier 210, level select 220, output pulldown 230, not enable 235, inverter 293, external bypass capacitor 287 and inputs 222, 222 and 223. One implementation in the prior art, the regulator, was part of the above-mentioned integrated circuit part number MC13783. Either the external pass device 185, as shown in FIG. 1, or the internal pass device 280, as shown in FIG. 2, was selected by switch 195 or 295 under control of a configure command on bus 190 or 290 from system controller 191 or 291.

The system controller 191 or 291 was a software based minicomputer or processor of its own integrated circuit separate and external to the integrated circuit of the regulator. An example of such processor was the MCIMX31 Multimedia Applications Processor by Freescale, Inc. The system controller was a separately packaged integrated circuit and separate from the MC13783 integrated circuit. This external system controller 191 and 291 was tasked with configuring a number of other devices within several other integrated circuits besides regulators. The system controllers were implemented with software by general microprocessors as well as combinations of microprocessors and digital signal processors (DSPs), generally referred to as baseband processors. The bus 190 or 290 carried many other commands to the integrated circuits to be controlled besides commands from the system controller 191 or 291 to the power regulator shown in FIGS. 1 and 2. Other circuits within the MC13783 integrated circuit were concurrently enabled or re-configured by the system controller 191 and 291 to minimize current drain.

The system controller 191, 291 usually accessed non-volatile memory (NVM), where software containing status for whether or not the external pass devices were part of the assembly was stored. If the particular regulator that has an internal or external pass device is needed as part of the power-up sequence, it may not have been appropriately configured at power-up.

BRIEF DESCRIPTION OF THE DRAWINGS

The present invention is illustrated by way of example and is not limited by the accompanying figures, in which like references indicate similar elements. Elements in the figures are illustrated for simplicity and clarity and have not necessarily been drawn to scale.

The details of the preferred embodiments will be more readily understood from the following detailed description when read in conjunction with the accompanying drawings wherein.

DETAILED DESCRIPTION OF THE PREFERRED EMBODIMENTS

In the above example of the art, care had to be used in defining the startup sequence to assure that the software for the system controller was correct and every circuit necessary for startup had a regulator that was active. None of these prior regulators could be set active by default to use either an internal or external pass device.

Figure 1:
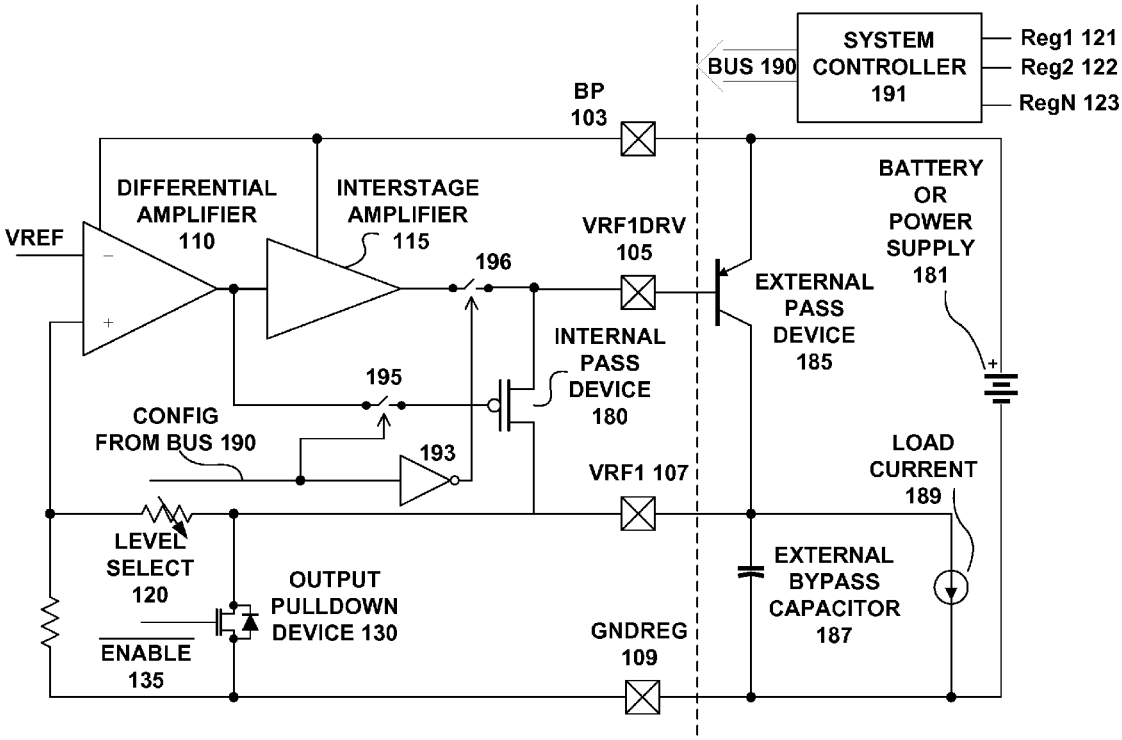
PRIOR ART FIG. 1
FIG. 1 illustrates a schematic block diagram of one example from the prior art where a regulator capable of supporting internal or external pass devices is configured to use an external pass device.
Figure 2:
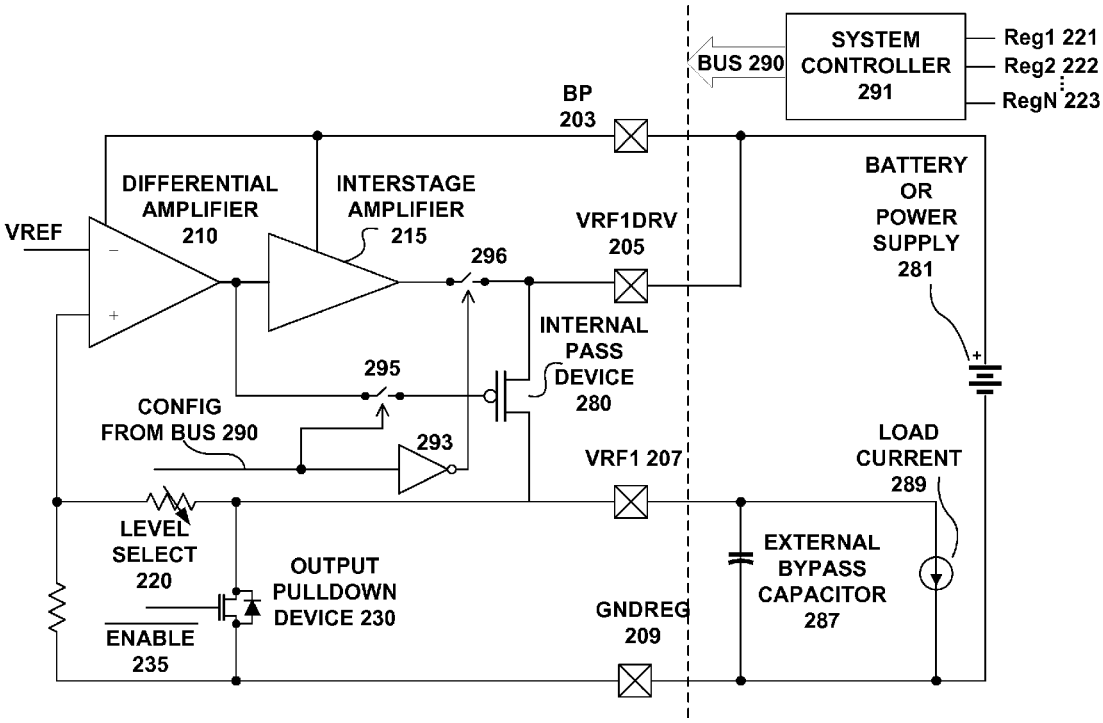
PRIOR ART FIG. 2
FIG. 2 illustrates a schematic block diagram of one example from the prior art where the regulator of FIG. 1 is configured to use an internal pass device.

A regulator with a default state for a regulator that may use internal or external pass devices may not have had the appropriate default state will be described next. Refer to FIG. 1 and assume that the regulator output is one of the regulator inputs Reg1 121, Reg2 122, . . . . RegN 123 that the system controller 191 or 291 needs for startup. If the default value for the configure command from bus 190 was to use an external pass device (as shown) but no external pass device was present, there would not be a regulator output present at node VRF1. If instead the default value of the configure command from the bus 190 or 290 was to use an internal pass device as shown in FIG. 2, but the circuit was connected as in FIG. 1 for an external pass device, again, no output voltage would have been created. In either event, the system controller 191 or 291 would not startup correctly, and the configure command from the bus 190 or 290, which is dependent on the system controller 191 or 291 starting up correctly, would not get generated. Note that the bus 190 to the MC13783 integrated circuit was a serial-parallel interface (SPI).

There were additional problems when specifically programming a regulator, such as using the same non-volatile memory for different makes of regulators.

Controlling the power up sequences of many regulators by the software of a system controller is complex and subject to programming error and timing issues mostly caused by human oversights and error. Whenever a regulator was changed in an application, the software needed to be updated which became problematic for several or even hundreds of regulators per integrated circuit. Furthermore, should the system controller minicomputer fail, the system could not start reliably nor could any regulator be used for the system controller minicomputer itself.

What is desired is a regulator that uses internal and external pass devices more flexibly and more reliably, without configuration intervention. It is also desired that, during the default startup sequence, a default state for an internal or external pass device mode is not needed because a regulator with a default state may not have the heretofore described appropriate default state. A generic "black box" regulator capable of easily accommodating an external pass device choice is desired, especially from a development viewpoint.

It is desired to automatically detect whether an external pass device is present, and to automatically configure a regulator to use the appropriate pass device and to optimize current drain for the entire regulator. Essentially, a circuit first is configured as if it will use the external pass device, and see if some parameter of the external pass device or regulator responds. This can be, as in one preferred embodiment, detecting that the output voltage starts to increase. There are other possibilities, such as detecting a voltage or current at the control point of the external pass device. If there is no response, then the circuit can be configured to use the internal pass device. Since this detection and configuration is automatic, the regulator can be used more generally, since it does not require pass device configuration by a system controller. It can therefore be used as a regulator that is necessary for the system controller to start up.

Figure 3:
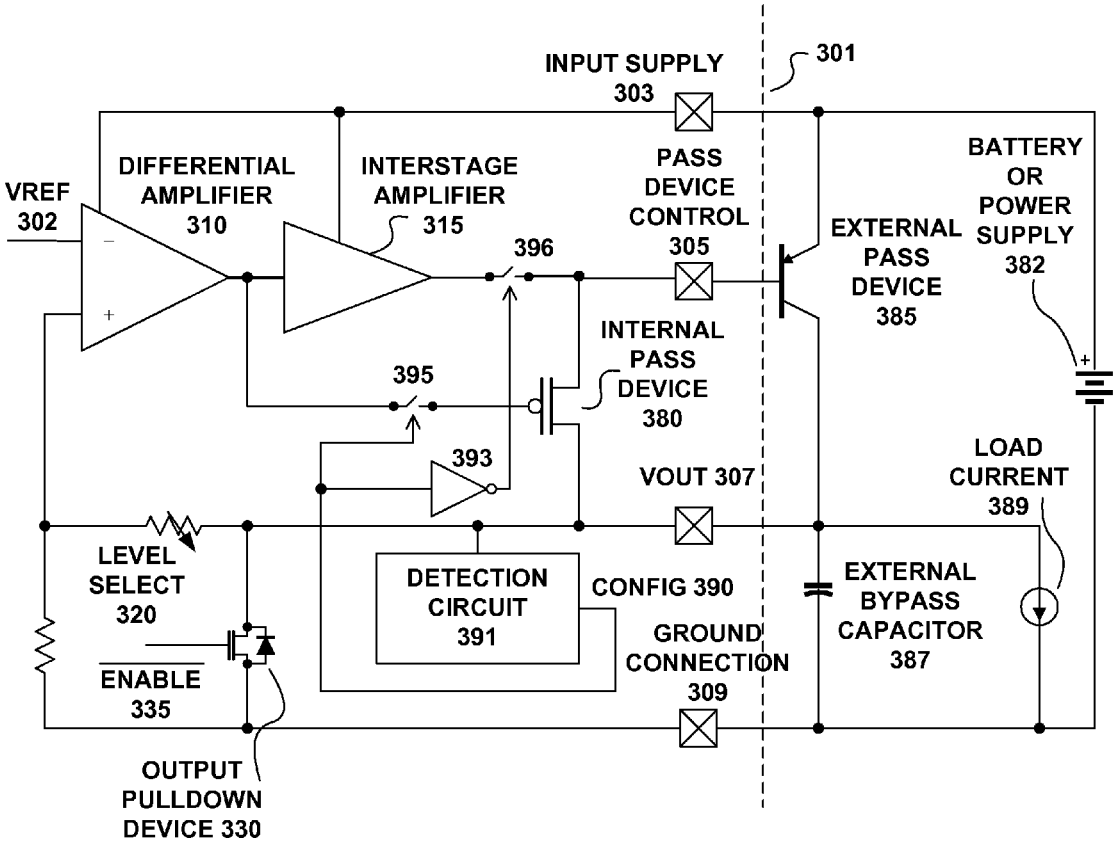
FIG. 3 illustrates a schematic block diagram of an application of a regulator capable of supporting internal or external pass devices having an internal detection circuit that automatically generates a configure signal to use an external pass device according to one embodiment of the present inventions.

FIG. 3 illustrates a schematic block diagram of an application of a power regulator capable of supporting internal or external pass devices having an internal detection circuit 391 that automatically generates a configure signal to use external pass device 385 according to one embodiment of the present inventions. In FIG. 3, the external pass device 385 is used. The detection circuit 391 automatically generates the configure signal 390. A power regulator circuit automatically disables an internal pass transistor 380 when a detection circuit 391 detects the presence of an external pass component 385. An integrated circuit can contain the power regulator circuit and the internal pass transistor 380. The power regulator circuit can be used on a power supply with a DC power source 382 such as a battery cell in the presence of an external bypass capacitor 387 to power a load such as load current 389. The output of the regulator for the load current 389 is at node VOUT. The internal pass transistor 380 is made in an integrated circuit along with a detection circuit 391 and a switch 395 for disabling the internal pass transistor 380. The detection circuit 391 detects a presence of an external pass component 385 external to the integrated circuit. The switch 395 automatically disables the internal pass transistor 380 when the detection circuit 391 detects the presence of the external pass component 385 external to the integrated circuit.

The detection circuit 391 has a comparator 550 for comparing a signal on an outside connection of the integrated circuit and a latch 510 operatively coupled to the comparator 550 and operates the switch 395 based on a comparison by the comparator 550. The comparator 550 compares a voltage 532 on an outside connection of the integrated circuit against a reference 534. The comparator 550 makes the comparison after power up of the regulator and delays operation of the comparison using a delay 520 until a predetermined time after power up.

The output of the detection circuit 391 is the configure signal 390 representing whether an internal or external pass device is present, and therefore configuring and enabling other portions of the regulator. The ENABLE signal 335 indicates when the regulator circuit is turned on and drives the output pulldown transistor 330. A level select variable resistor 320 adjusts the output level of the regulator. When the regulator circuit is turned on, with the ENABLE signal 335, the detection circuit 391 starts a timer. Before the timer expires, (or at least until a determination of whether the external pass device is present) the regulator is configured as if an external pass device is present. This timer can be implemented as the delay 520, 620, 720 which will later be described with reference to FIGS. 5-8. Assuming that an external pass device 385 is present, the regulator is thus configured, and will function correctly. If no external pass device 385 is present, that will be sensed by the detection circuit 391, and when the timer expires, the regulator will be configured for operation on the internal pass device 380.

The power regulator can have an interstage amplifier 315 and a switch 396 can also enable the interstage amplifier 315 in the presence of the external pass device 385 and also disable the interstage amplifier 315 in the absence of the external pass device 385. An inverter 393 can be used to invert the configure signal 390 to the switch 396. The power regulator circuit can be a linear power regulator such as a low dropout LDO regulator.

The elements illustrated in FIG. 3 to the left of the vertical dashed line 301 makeup the power regulator. An integrated circuit can contain the power regulator of FIG. 3 on a substrate in a package. The external pass device 385 can exist external to the package of the integrated circuit. A multiple chip module can contain the external pass device 385 as a separate component within the same package. The four pins illustrated in FIG. 3 labeled INPUT SUPPLY 303, PASS DEVICE CONTROL 305, VOUT 307 AND GROUND 309 are the interface to the power regulator.

Figure 4:
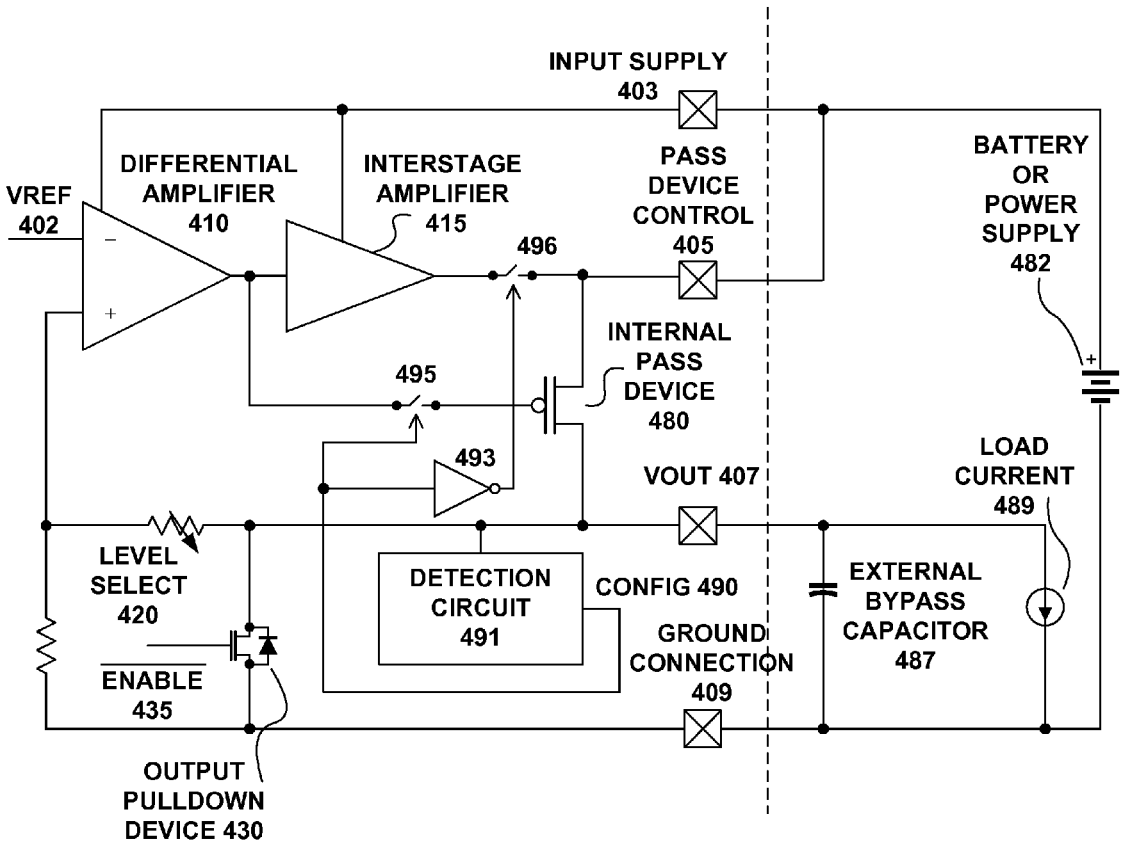
FIG. 4 illustrates a schematic block diagram of an application of a regulator capable of supporting internal or external pass devices having an internal detection circuit that automatically generates a configure signal to use an internal pass device according to one other embodiment of the present inventions.

FIG. 4 illustrates a schematic block diagram of an application of a power regulator capable of supporting internal or external pass devices having an internal detection circuit 491 that automatically generates a configure signal to use an internal pass device 480 according to another one embodiment of the present inventions. In FIG. 4, the internal pass device 480 is used. The detection circuit 491 automatically generates the configure signal 490. A power regulator circuit automatically disables an internal pass transistor when a detection circuit 491 detects the presence of an external pass component 485. Otherwise the internal pass device 480 is enabled. An integrated circuit can contain the power regulator circuit and the internal pass transistor 480. The power regulator circuit can be used on a power supply with a DC power source 482 such as a battery cell in the presence of an external bypass capacitor 487 to power a load such as load current 489. The output of the regulator for the load current 489 is at node VOUT. The internal pass transistor 480 is made in an integrated circuit along with a detection circuit 491 and a switch 495 for enabling the internal pass transistor 480. The detection circuit 491 detects an absence of an external pass component external to the integrated circuit. The switch 495 automatically enables the internal pass transistor 480 when the detection circuit 491 detects the absence of the external pass component external to the integrated circuit.

The output of the detection circuit 491 is the configure signal 490 representing whether an internal or external pass device is present, and therefore configuring and enabling other portions of the regulator. A level select variable resistor 420 adjusts the output level of the regulator. The ENABLE signal 435 indicates when the regulator circuit is turned on and drives the output pulldown transistor 430.

The power regulator can have an interstage amplifier 415 and a switch 496 can also enable the interstage amplifier 415 in the presence of the external pass device 485 and also disable the interstage amplifier 415 in the absence of the external pass device 485. An inverter 493 can be used to invert the configure signal 490 to the switch 496.

The detection circuit 391 or 491 of FIG. 3 or 4 has a comparator and its operation will be described in greater detail with reference to the exemplary embodiments of FIGS. 5-7. The four pins illustrated in FIG. 4 labeled INPUT SUPPLY 403, PASS DEVICE CONTROL 405, VOUT 407 AND GROUND 409 are the interface to the power regulator.

Figure 5:
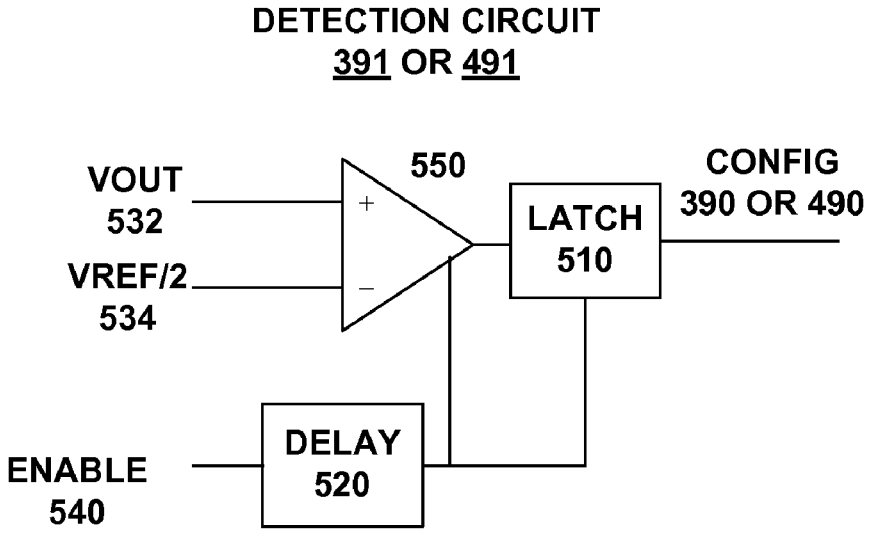
FIGS. 5-8 illustrate schematic diagrams of exemplary constructions of detection circuits according to other alternative embodiments of the present inventions.

FIG. 5 illustrates a schematic diagram of an exemplary construction of detection circuits according to one other alternative embodiment of the present inventions. A simple and effective way of detecting the presence of an external or an internal pass device is to monitor the output voltage, as shown in the detection circuit 391, 491 of FIGS. 3 and 4. If the external pass device is present, then as described above, the power regulator will operate during the timer's delay period, and the voltage will increase. We selected a simple VREF/2 534 threshold, which is half the VREF node 302 or 402 of FIGS. 3 and 4, but certainly other thresholds are possible. Also, we selected VOUT 532, which is the VOUT node 307 or 407 of FIGS. 3 and 4, but the sampled signal could also be some fraction of the output voltage, as can be found in the feedback circuit of the regulator or some other sample of the output voltage VOUT. If no external pass device was present, then there would be no way to charge up the output voltage, and VOUT would be near zero at then end of the delay 520. The delay 520, which can be implemented either as a digital timer or analog delay, causes a latch 510 to hold the output of comparator 550. The output of the latch 510 provides the configure signal 390, 490.

Another way to detect the presence of an external pass device is to monitor some of the internal signals of a power regulator. This can be done in largely two different approaches, as will be described below with reference to the embodiments of FIGS. 6 and 7. FIG. 8 will also be shown as an alternative embodiment for FIG. 7.

Figure 6:
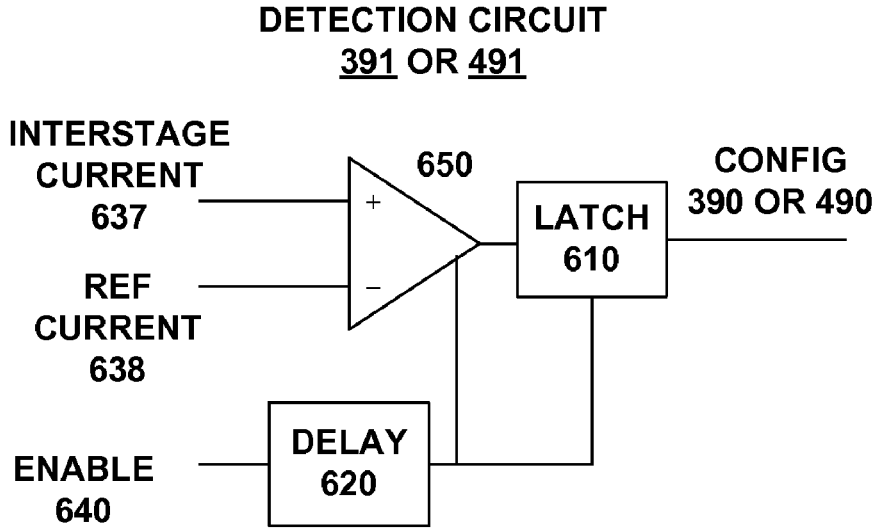

FIG. 6 illustrates a schematic diagram of an exemplary construction of detection circuits according to another alternative embodiment of the present inventions. The comparator is implemented to have an offset so that if the differential signal is less than the offset, we would say that there is no external pass device. Other approaches can be used to create comparators with offset, either by including an offset signal or by designing bias into the comparator. Another way to detect the presence of an external or an internal pass device is to, monitor the differential between the INTERSTAGE CURRENT 637 which is some fraction of the current in the interstage amplifier 315, 415 in FIGS. 3 and 4 and a given REF CURRENT 638. In the example of FIG. 6 the input signals are currents. Consider that if we do not connect the INPUT SUPPLY node to PASS DEVICE CONTROL node, but leave the PASS DEVICE CONTROL node to remain high impedance, then the operation of the regulator in the absence of a pass device would be to create a large error signal within the regulator. This naturally results because the regulator is trying to achieve equilibrium at a given output voltage but cannot since there is no external pass device, and the internal pass device is not selected. So the comparator 650, again using an offset such that if an external pass device is present, the error signal is less than this offset, but if no external pass device is present, the signal is larger than the offset. In FIG. 6, the operation of the delay 620 and latch 610 are the same as in FIGS. 5 and 6.

Another way to detect is represented in FIG. 6. Following the same strategy, the initial value of "configure" is to assume that there is an external pass device. But, again, if there is no external pass device, the operation of the regulator will generally cause the error amplifier or interstage amplifier to go to a higher current mode than if equilibrium can be found. Though sampling the interstage amplifier current and comparing it to some reference is shown by example, it should be understood that the error amplifier or some supply current could be used as well. The signal to monitor could be within a differential amplifier 310 or 410 or some signal within the inter-stage amplifier 315 or 415, e.g., it could be the current within the inter-stage amplifier or the output of the error amplifier. And again, numerous techniques and circuits exist for such comparators.

Figure 7:
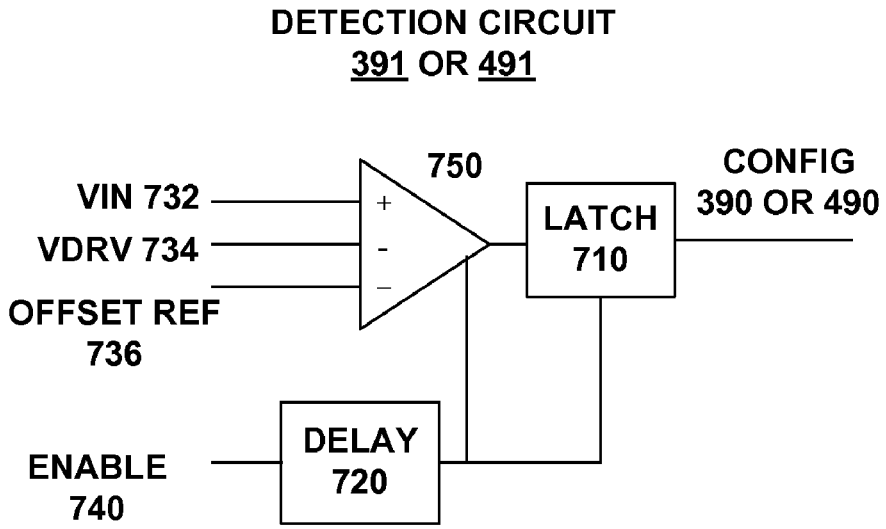
Figure 8:
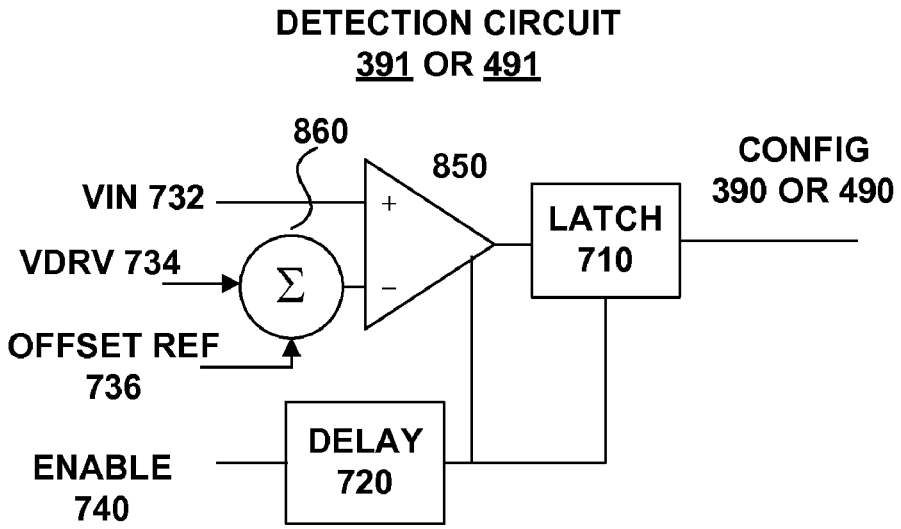

FIG. 7 illustrates a schematic diagram of an exemplary construction of detection circuits according to one other alternative embodiment of the present inventions. Referring to FIG. 7, the detection circuit monitors the difference between the VIN 732 which is the INPUT SUPPLY node 303 or 403 of FIGS. 3 and 4 and VDRV 734 which is the PASS DEVICE CONTROL node 305 or 405 of FIGS. 3 and 4. An offset reference 736 is used at the second inverting input of the comparator 750 to provide a threshold for the difference between VIN 732 and VDRV 734. The comparator 750 can be configured as a three input device as illustrated in FIG. 7 or, in an alternate embodiment, as a cascade of an adder and a comparator, each with two inputs. The embodiment of FIG. 8 illustrates an alternative construction of the comparator 750 with two inputs. Another alternative embodiment for implementing FIG. 7 with a two input comparator, besides FIG. 8, is to configure the comparator 750 to have a bias so that the comparator does not change states until the differential between the VIN 732 and VDRV 734 is greater than some offset. FIG. 4 illustrates that PASS DEVICE CONTROL is connected to the INPUT SUPPLY. If that approach is used, then there is virtually no differential signal between the upper two ports of the comparator 750, and the VDRV 734 causes a low state for the comparator. On the other hand, if there was an external pass device, then the operation of the regulator would need a signal between VIN 732 and VDRV 734 that was larger than the offset REF 736 and the comparator would take the opposite state. Again, at the end of the delay period 750, the comparator output is registered in the latch 710.

FIG. 8 illustrates a schematic diagram of an alternative exemplary construction of the detection circuit of FIG. 7. Referring to FIG. 8, the detection circuit monitors the difference between the VIN 732 which is the INPUT SUPPLY node 303 or 403 of FIGS. 3 and 4 and the sum of VDRV 734 which is the PASS DEVICE CONTROL node 305 or 405 of FIGS. 3 and 4 and an offset reference 736. Adder 860 may or may not exist as a distinct circuit, and may be embedded in the comparator 850 so that the comparator 850 is a three input device. This provides a threshold for the difference between VIN 732 and VDRV 734. FIG. 4 illustrates that the PASS DEVICE CONTROL is connected to the INPUT SUPPLY. If that approach of that embodiment is used, then there is virtually no differential signal between the upper two ports of the comparator 850, and the VDRV 734 causes a low state for the comparator. On the other hand, if there was an external pass device, then the operation of the regulator would need a signal between VIN 732 and VDRV 734 that was larger than the offset REF 736 and the comparator would take the opposite state. Again, at the end of the delay period 850, the comparator output is registered in the latch 710.

A self-configuring power regulator that uses internal or external pass devices operates more flexibly and more reliably without configuration intervention or user error. A self configuring power regulator also makes it easier for a designer to use different kinds of regulators from different vendors or change the use of internal or external pass devices during the development process.

Although the invention is described herein with reference to specific embodiments, various modifications and changes can be made without departing from the scope of the present invention as set forth in the claims below. Accordingly, the specification and figures are to be regarded in an illustrative rather than a restrictive sense, and all such modifications are intended to be included within the scope of the present invention. Any benefits, advantages, or solutions to problems that are described herein with regard to specific embodiments are not intended to be construed as a critical, required, or essential feature or element of any or all the claims. Though one or more of the embodiments of the inventions are applicable to continuous time regulators, whether or not they are low-drop out (LDO) regulators, other embodiments might be applied to other types of regulators such as switched mode regulators. It should be understood that circuitry described herein may be implemented either in silicon or another semiconductor material or alternatively, such as, for example, the detection circuit 391 or 491, among others, may be implemented by software code representation of silicon or another semiconductor material.

Unless stated otherwise, terms such as "first" and "second" are used to arbitrarily distinguish between the elements such terms describe. Thus, these terms are not necessarily intended to indicate temporal or other prioritization of such elements.

What is claimed is:

1. A power regulator control circuit having detection of a presence of an external pass device external to the power regulator control circuit, the power regulator control circuit comprising:

an amplifier for regulating an output voltage, wherein the amplifier comprises an interstage amplifier;

an internal pass device;

a detection circuit for monitoring internally within the power regulator control circuit a signal magnitude of the amplifier and detecting a presence of the external pass device after a predetermined time after power up, wherein the detection circuit comprises a comparator for compairing the monitored signal magnitude of the amplifier on a inside connection of the power regulator control circuit and thereby monitors internally within the power regulator control circuit; and a switch operatively coupled to the detection circuit and the internal pass device for automatically disabling the internal pass device when the detection circuit detects the presence of the external pass device external to the power regulator control circuit, wherein the switch is operatively coupled to the interstage amplifier to enable the interstage amplifier in the presence of the external pass device and to disable the interstage amplifier in the absence of the external pass device.

2. A power regulator control circuit according to claim 1, wherein the comparator makes the comparison after power up of the power regulator control circuit.

3. A power regulator control circuit according to claim 2, wherein the comparator further comprises a delay element operatively coupled to the comparator to delay operation of the comparison until a predetermined time after power up and thereby detects after a predetermined time after power up.

4. A power regulator control circuit according to claim 1, wherein the amplifier further comprises a differential amplifier.

5. An integrated circuit comprising a power regulator circuit, the power regulator circuit comprising an internal pass transistor;

an amplifier for regulating an output voltage, wherein the amplifier comprises an interstage amplifier;

a detection circuit for monitoring internally within the power regulator control circuit a signal magnitude of the amplifier and detecting a presence of an external pass device external to the integrated circuit after a predetermined time after power up; and a switch operatively coupled to the detection circuit and the internal pass transistor for automatically disabling the internal pass transistor when the detection circuit detects the presence of the external pass device external to the integrated circuit, wherein the switch is operatively coupled to the interstage amplifier to enable the interstage amplifier in the presence of the external pass device and to disable the interstage amplifier in the absence of the external pass devise.

6. An integrated circuit according to claim 5, wherein the detection circuit comprises a comparator for comparing the monitored signal magnitude on an inside connection of the power regulator on the integrated circuit.

7. An integrated circuit according to claim 6, wherein the detection circuit further comprises a latch operatively coupled to the comparator and the switch to operate the switch based on a comparison by the comparator.

8. An integrated circuit according to claim 6, wherein the comparator further comprises a delay element operatively coupled to the comparator to delay operation of the comparison until a predetermined time after power up.

9. An integrated circuit according to claim 5, wherein the power regulator circuit comprises a linear power regulator.

10. An integrated circuit according to claim 9, wherein the linear power regulator comprises a low dropout regulator.

11. An integrated circuit comprising a power regulator circuit, the power regulator circuit comprising an internal pass transistor:

an amplifier for regulating an output voltage;

a detection circuit for monitoring internally within the power regulator control circuit a signal magnitude comprising a current in the amplifier and detecting a presence of an external pass device external to the intergrated circuit after a predetermined time after power up; and a switch operatively coupled to the detection circuit and the internal pass transistor for automatically disabling the internal pass transistor when the detection circuit detects the presence of the external pass device external to the intergrated circuit.

12. An integrated circuit comprising a power regulator circuit, the power regulator circuit comprising;

an internal pass transistor;

an amplifier for regulating an output voltage;

a detection circuit for monitoring internally within the power regulator control circuit a signal magnitude of the amplifier comprising an internal differential measurement relative to a supply to the amplifier in the amplifier and detecting a presence of an external pass device external to the intergrated circuit after a predetermined time after power up; and a switch operatively coupled to the detection circuit and the internal pass transistor for automatically disabling the internal pass transistor when the detection circuit detects the presence of the external pass device external to the intergrated circuit.

13. An integrated circuit according to claim 12, wherein the amplifier further comprises an interstage amplifier; and wherein the switch is operatively coupled to the interstage amplifier to enable the interstage amplifier in the presence of the external pass device and to disable the interstage amplifier in the absence of the external pass device.

14. An integrated circuit according to claim 12, wherein the monitored signal magnitude of the amplifier comprises an internal differential voltage measurement relative to a supply to the amplifier in the amplifier.

15. A power regulator control circuit having detection of a presence of an external pass device external to the power regulator control circuit, the power regulator control circuit comprising;

an amplifier for regulating, an output voltage;

an internal pass device;

a detection circuit for monitoring internally within the power regulator control circuit a signal magnitude comprising a current in the amplifier and detecting a presence of the external pass device after a predetermined time after power up, wherein the detection circuit comprises a comparator for comparing the monitored signal magnitude of the amplifier on the inside connection of the power regulator control circuit and thereby monitors internally within the power regulator control circuit; and a switch operatively coupled to the detection circuit and the internal pass device for automatically disabling the internal pass device when the detection circuit detects the presence of the external pass device external to the power regulator control circuit.

16. A power regulator control circuit according to claim 15, wherein the amplifier further comprises an interstage amplifier; and wherein the switch is operatively coupled to the interstage amplifier to enable the interstage amplifier in the presence of the external pass device and to disable the interstage amplifier in the absence of the external pass device.

17. A power regulator control circuit having detection of a presence of an external pass device external to the power regulator control circuit, the power regulator control circuit comprising;

an amplifier for regulating an output voltage;

an internal pass device;

a detection circuit for monitoring internally within the power regulator control circuit a signal magnitude of the amplifier comprising an internal differential measurement relative to a supply to the amplifier in the amplifier and detecting a presence of the external pass device after a predetermined time after power up, wherein the detection circuit comprises a comparator for comparing the monitored signal magnitude of the amplifier on an inside connection of the power regulator control circuit and thereby monitors internally within the power regulator control circuit; and a switch operatively coupled to the detection circuit and the internal pass device for automatically disabling the internal pass device when the detection circuit detects the presence of the external pass device external to the power regulator control circuit.

18. A power regulator control circuit according to claim 17, wherein the monitored signal magnitude of the amplifier comprises an internal differential voltage measurement relative to a supply to the amplifier in the amplifier.

* * * * *

UNITED STATES PATENT AND TRADEMARK OFFICE

CERTIFICATE OF CORRECTION

PATENT NO. : 8,378,648 B2
APPLICATION NO. : 12/606826
DATED : February 19, 2013
INVENTOR(S) : Richard T Unetich et al.

It is certified that error appears in the above-identified patent and that said Letters Patent is hereby corrected as shown below:

IN THE CLAIMS

Column 8, in claim 1, line 13, “compairing” should read --comparing--.

Column 9, in claim 5, line 7, “devise” should read --device--.

Column 9, in claim 11, line 8, “intergrated” should read --integrated--.

Column 9, in claim 11, last line, “intergrated” should read --integrated--.

Column 9, in claim 12, line 10, “intergrated” should read -- integrated--.

Column 9, in claim 12, last line, “intergrated” should read --integrated--.

Column 10, in claim 16, last line, “devise” should read --device--.

Signed and Sealed this
Ninth Day of April, 2013

Teresa Stanek Rea
*Acting Director of the United States Patent and Trademark Office*